US007543826B2

(12) United States Patent
Labonté et al.

(10) Patent No.: US 7,543,826 B2
(45) Date of Patent: Jun. 9, 2009

(54) METHOD OF CUSTOMIZING A BLADE HOLDER FOR AN ICE SKATE

(75) Inventors: Ivan Labonté, Montreal (CA); Chris Langevin, Prévost (CA)

(73) Assignee: Bauer Hockey, Inc., Greenland, NH (US)

( * ) Notice: Subject to any disclaimer, the term of this patent is extended or adjusted under 35 U.S.C. 154(b) by 0 days.

(21) Appl. No.: 12/216,013

(22) Filed: Jun. 27, 2008

(65) Prior Publication Data

US 2008/0265531 A1 Oct. 30, 2008

Related U.S. Application Data

(62) Division of application No. 11/603,830, filed on Nov. 24, 2006, now Pat. No. 7,392,991, which is a division of application No. 10/995,222, filed on Nov. 24, 2004.

(51) Int. Cl.
*A63C 3/00* (2006.01)

(52) U.S. Cl. ..... 280/11.18; 280/11.12; 280/11.17; 280/11.203; 280/11.223; 280/11.27

(58) Field of Classification Search ..... 280/11.203, 280/11.223, 11.27, 14.21, 28, 11.17, 11.18, 280/11.12
See application file for complete search history.

(56) References Cited

U.S. PATENT DOCUMENTS 3,934,892 A 1/1976 Baikie
D245,872 S 9/1977 Baikie et al.
4,074,909 A 2/1978 Baikie
D250,490 S 12/1978 Baikie et al.
D268,125 S 3/1983 Baikie
D271,036 S 10/1983 Baikie
4,753,006 A 6/1988 Howe
5,484,148 A 1/1996 Olivieri
5,810,682 A 9/1998 Carruthers
6,041,530 A 3/2000 Matthews et al.
6,044,561 A 4/2000 Baraky et al.
6,164,667 A 12/2000 Olivieri
6,164,729 A * 12/2000 Dibenedetto et al. ..... 301/5.304
6,471,609 B1 10/2002 Fell
6,523,835 B1 2/2003 Lyden
6,655,269 B2 * 12/2003 Litke ..... 101/34
D488,845 S 4/2004 Labonté et al.
6,851,680 B2 * 2/2005 Pham et al. ..... 280/11.18

* cited by examiner

*Primary Examiner*—Christopher P Ellis
*Assistant Examiner*—Katy Meyer

(57) ABSTRACT

A method of customizing a blade holder for an ice skate, comprising: (a) providing to a customer a blade holder body being at least partly made of a clear material and comprising a front pedestal with a front inner surface, a rear pedestal with a rear inner surface and a bridge portion interconnecting said front and rear pedestals, the front and rear inner surfaces defining respective front and rear cavities; (b) providing to the customer a plurality of graphical elements; (c) receiving from the customer an indication of a certain graphical element selected from the plurality of graphical elements; and (d) applying the selected graphical element to one of the front and rear inner surfaces such that the selected graphical element is visible through the clear material.

5 Claims, 5 Drawing Sheets

METHOD OF CUSTOMIZING A BLADE HOLDER FOR AN ICE SKATE

The present patent application is a divisional application of U.S. patent application Ser. No. 11/603,830 filed on Nov. 24, 2006 now U.S. Pat. No. 7,392,991, which is a divisional application of U.S. patent application Ser. No. 10/995,222 filed on Nov. 24, 2004. The contents of these previous applications are incorporated herein by reference.

FIELD OF THE INVENTION

The present invention relates to a method of customizing a blade holder for an ice skate.

BACKGROUND OF THE INVENTION

An ice skate typically includes a skate boot for receiving a foot of a user, an ice skate blade for engaging an ice surface, and a blade holder holding the ice skate blade and attached to the skate boot.

A blade holder is usually made of a rigid polymeric material and is hollow in construction, for weight considerations. Normally, a blade holder is opaque and of a specific color such as black or white. Some blade holders have been made of transparent material but have enjoyed limited success in the industry.

Accordingly, there is a need in the industry for improvements in the appearance of ice skate blade holders and, more particularly, for a clear ice skate blade holder with customizable visual characteristics.

SUMMARY OF THE INVENTION

As embodied and broadly described herein, the invention provides a method of customizing a blade holder for an ice skate, comprising: (a) providing to a customer a blade holder body being at least partly made of a clear material and comprising a front pedestal with a front inner surface, a rear pedestal with a rear inner surface and a bridge portion interconnecting said front and rear pedestals, the front and rear inner surfaces defining respective front and rear cavities; (b) providing to the customer a plurality of graphical elements; (c) receiving from the customer an indication of a certain graphical element selected from the plurality of graphical elements; and (d) applying the selected graphical element to one of the front and rear inner surfaces such that the selected graphical element is visible through the clear material.

These and other aspects and features of the present invention will now become apparent to those of ordinary skill in the art upon review of the following description of specific embodiments of the invention in conjunction with the accompanying drawings.

BRIEF DESCRIPTION OF THE DRAWINGS

A detailed description of embodiments of the present invention is provided herein below, by way of example only, with reference to the accompanying drawings, in which.

Figure 1:
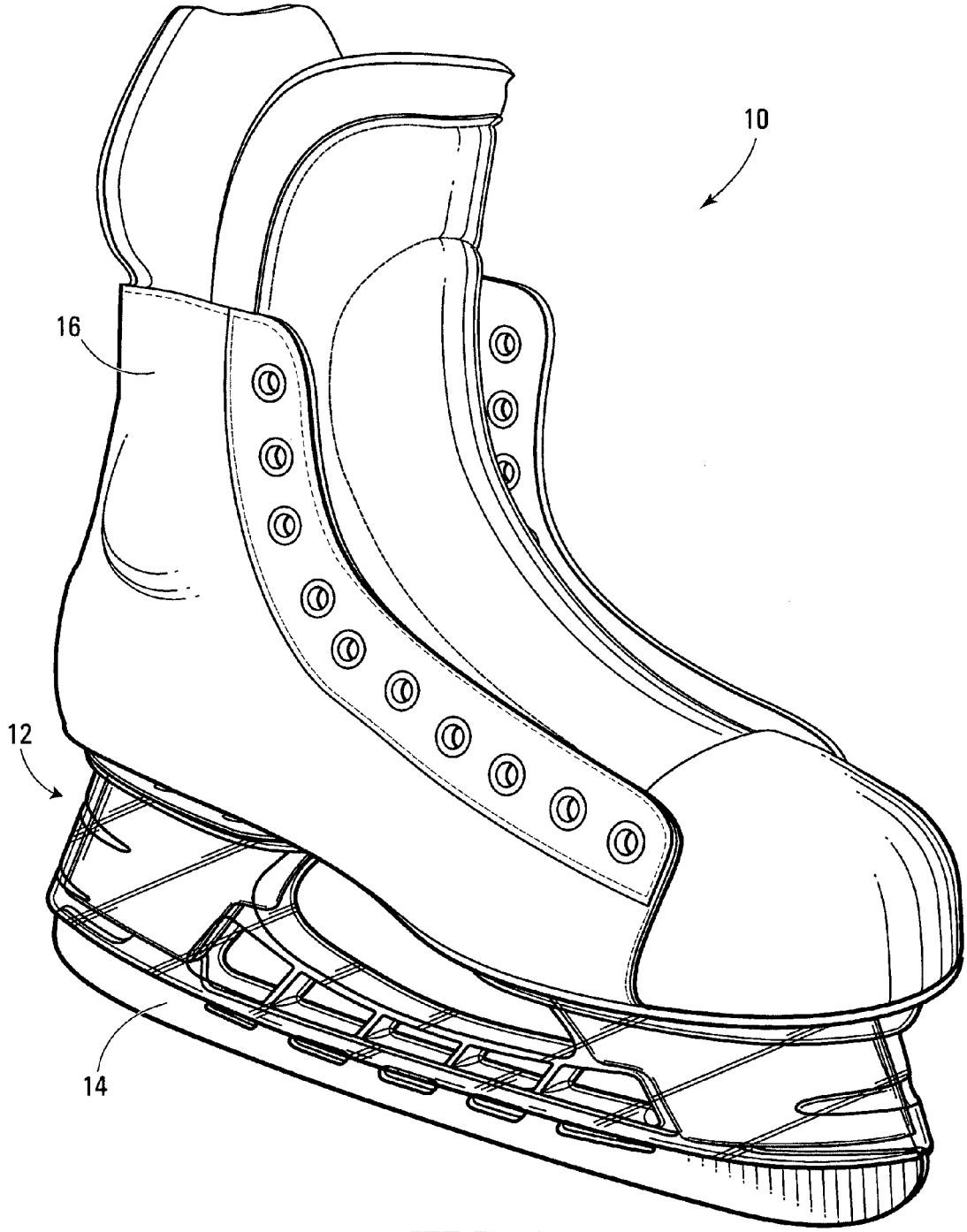
FIG. 1 is a perspective view of an ice skate including a blade holder in accordance with an embodiment of the present invention.
Figure 2:
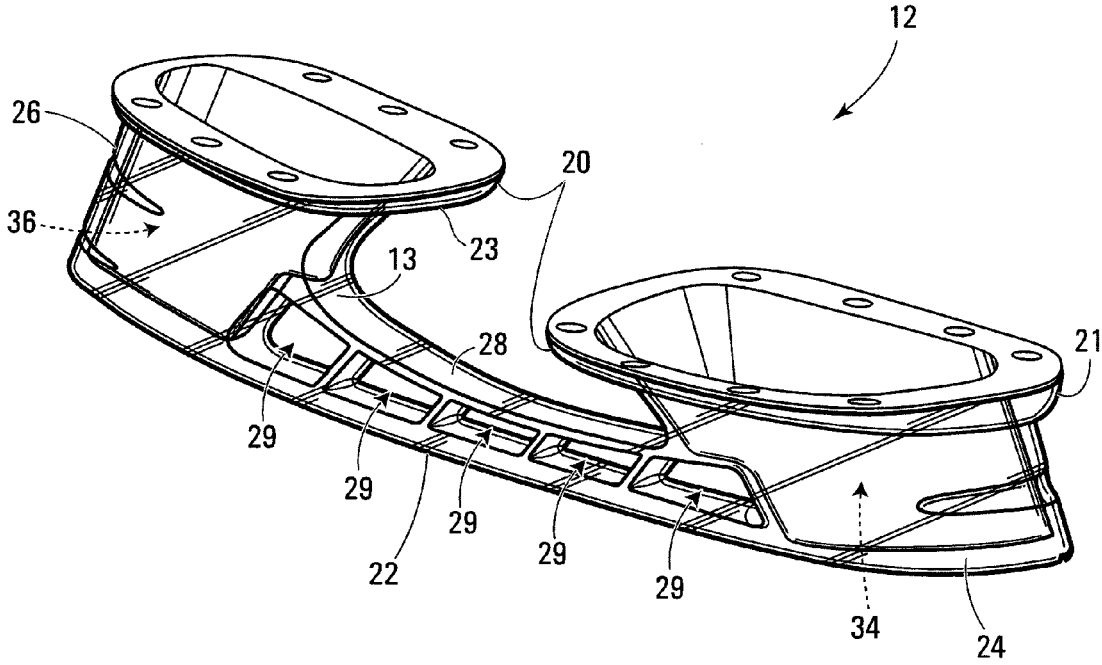
FIG. 2 is a perspective view of the blade holder shown in FIG. 1.
Figure 3:
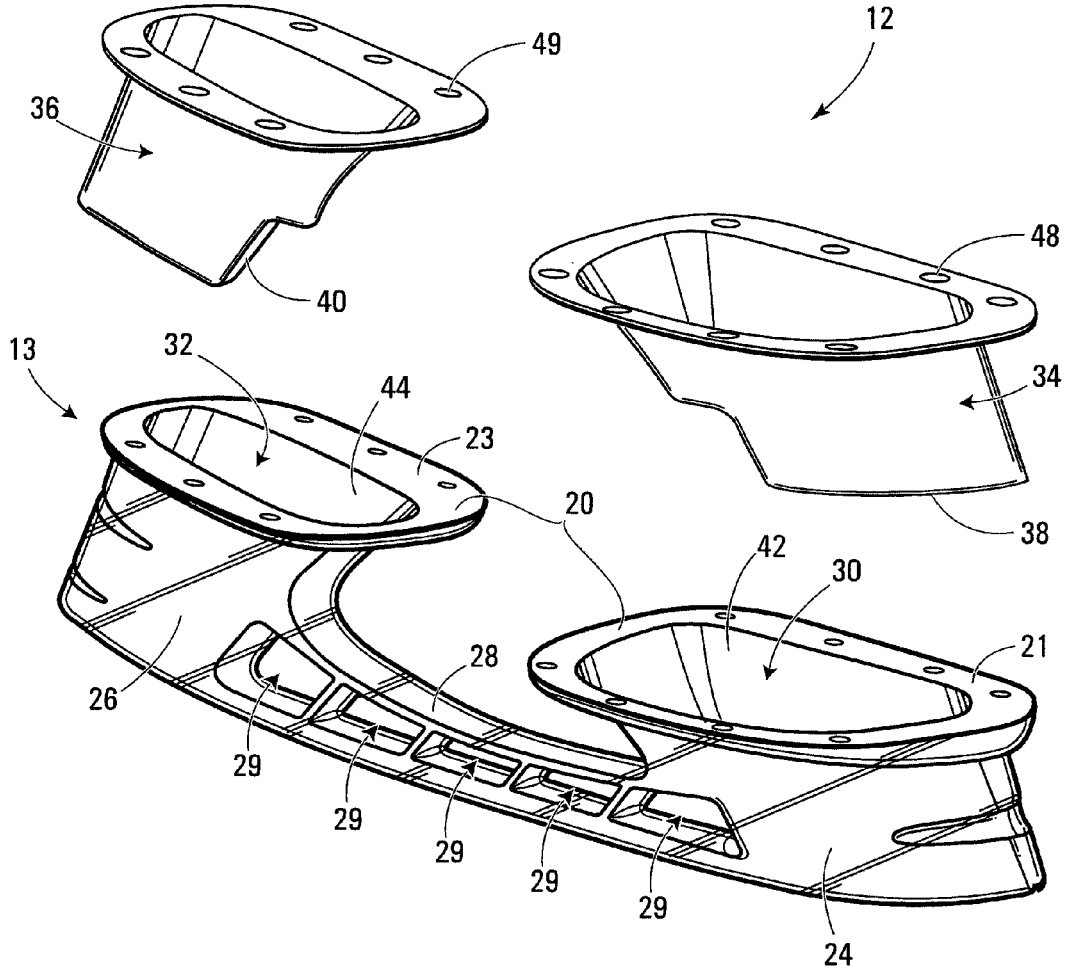
FIG. 3 is a perspective exploded view of the blade holder shown in FIG. 2.
Figure 4:
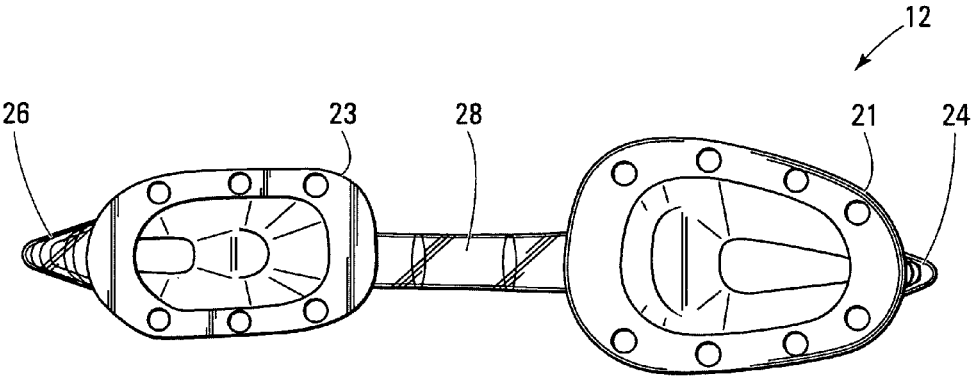
FIG. 4 is a top view of the blade holder shown in FIG. 2.
Figure 5:
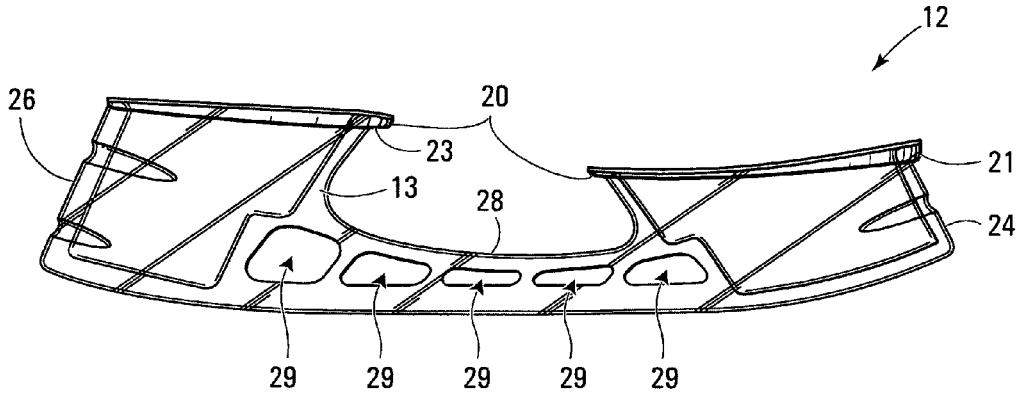
FIG. 5 is a side elevation view of the blade holder shown in FIG. 2.
Figure 6:
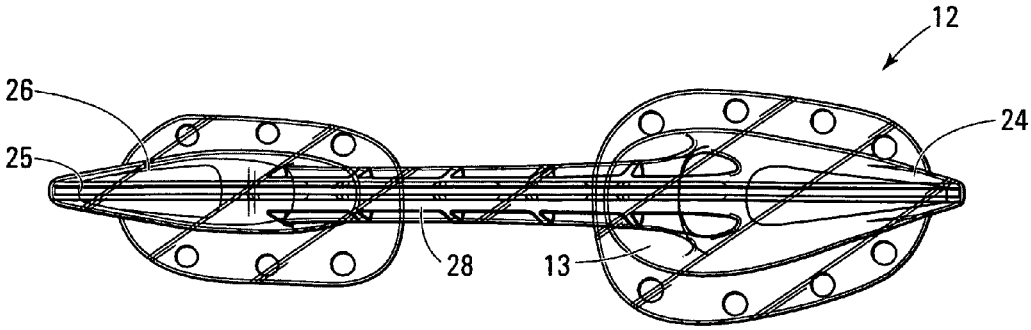
FIG. 6 is a bottom view of the blade holder shown in FIG. 2.
Figure 7:
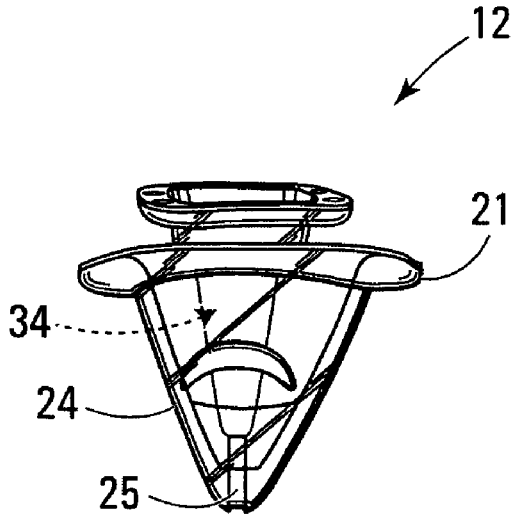
FIG. 7 is a front elevation view of the blade holder shown in FIG. 2.
Figure 8:
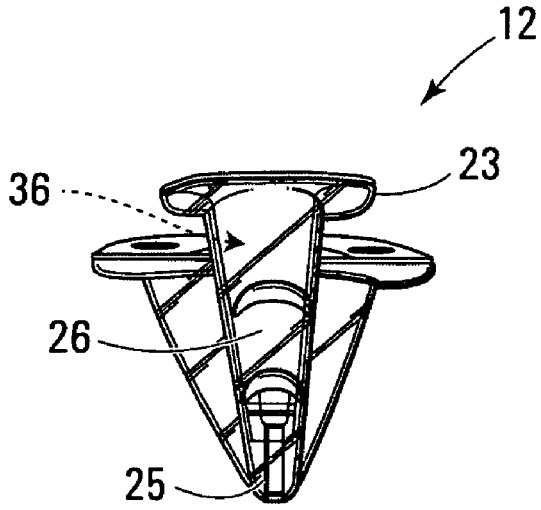
FIG. 8 is a rear elevation view of the blade holder shown in FIG. 2.

In the drawings, the embodiments of the invention are illustrated by way of examples. It is to be expressly understood that the description and drawings are only for the purpose of illustration and are an aid for understanding. They are not intended to be a definition of the limits of the invention.

DETAILED DESCRIPTION

FIG. 1 shows an ice skate 10 having a blade holder 12 in accordance with an embodiment of the invention. The blade holder 12 has an ice skate blade 14 and is attached to a skate boot 16 of the ice skate 10.

Referring to FIGS. 2 to 8, the blade holder 12 comprises a body 13 having a top portion 20 for attachment to the skate boot 16 and a bottom portion 22 for receiving the ice skate blade 14. The body 13 has a front portion 24, a rear portion 26, and a bridge portion 28 interconnecting the front portion 24 and the rear portion 26. In the illustrated embodiment, the front portion 24 is configured as a front pedestal, the rear portion 26 is configured as a rear pedestal, and the bridge portion 28 has a plurality of apertures 29 for reducing the weight of the body 13 of the blade holder 12. The upper edges of the apertures 29 follow a concave imaginary line while the lower edges of the apertures 29 follow a generally straight imaginary line.

The top portion 20 has a front top portion 21 located on the front portion 24 and a rear top portion 23 located on the rear portion 26. Each one of the front top portion 21 and the rear top portion 23 is adapted to be attached to a sole of the skate boot 16 using fasteners such as rivets, bolts, or other suitable fasteners. The bottom portion 22 has a longitudinal slot 25 for receiving the ice skate blade 14.

It is to be understood that multiple other configurations are possible for the body of the blade holder without departing from the scope of the invention.

The front portion 24 is made of a clear material and defines a front cavity 30. The rear portion 26 is also made of the clear material and defines a rear cavity 32. In fact, in the illustrated embodiment, the entire body 13 of the blade holder 12 is made of the clear material. However, it is to be understood that, in other embodiments, only certain portions of the body 13 of the blade holder 12 may be made of a clear material while other portions may not be made of a clear material. For example, in a specific embodiment, each one of the front portion 24 and the rear portion 26 may be made of a clear material while the bridge portion 28 may not be made of a clear material.

The clear material is a material capable of being seen through. The clear material can be colorless or colored. Also, the clear material can include a first region characterized by a first degree of transparency and a second region characterized by a second degree of transparency different from the first degree of transparency. The different degrees of transparency can be achieved, for instance, by a different surface finish or thickness of the first and second regions. The clear material may be a polymeric material such as, Acrylic, clear polymer or polycarbonate.

The body 13 of the blade holder 12 can be manufactured using known processes, including but not limited to an injection molding process.

The blade holder 12 also comprises a front graphical element 34 inside the front cavity 30 and visible through the clear material of the front portion 24, and a rear graphical element 36 inside the rear cavity 32 and visible through the clear material of the rear portion 26. More specifically, the front graphical element 34 is characterized by at least one of a colored area, a mark, a symbol, and a logo visible through the clear material of the front portion 24. Similarly, the rear graphical element 36 is characterized by at least one of a colored area, a mark, a symbol, and a logo visible through the clear material of the rear portion 26.

In the illustrated embodiment, the front graphical element 34 is a front insert 38 disposed inside of the front cavity 30, and the rear graphical element 36 is a rear insert 40 disposed inside of the rear cavity 32. The front insert 38 may have a contour following an inner surface 42 of the front portion 24 defining the front cavity 30. The front insert 38 may also have a flange 48 that at least partially overlies the front top portion 21 such that attachment of the front top portion 21 to the sole of the skate boot 14 secures the front insert 38 inside the front cavity 30. Alternatively, the front insert 38 may be affixed, for instance by being glued, to the inner surface 42 of the front portion 24. Similarly, the rear insert 40 may have a contour following an inner surface 44 of the rear portion 26 defining the rear cavity 32, and may have a flange 49 that at least partially overlies the rear top portion 23 such that attachment of the rear top portion 23 to the sole of the skate boot 14 secures the rear insert 40 inside the rear cavity 32.

The front insert 38 may be of a first color, while the rear insert 40 may have a second color different from the first color. As noted previously, various other visual characteristics can be included on each one of the front and rear inserts 38 and 40 without departing from the scope of the invention.

Each one of the front and rear inserts 38, 40 may be made of a polymeric material such as, polyethylene, polystyrene, polyurethane or polypropylene, polycarbonate. These front and rear inserts 38, 40 may also be made of carbon, fiberglass, titanium, aluminum, Kevlar, paper, cardboard or foam. Alternatively, each one of the front and rear inserts 38, 40 may be made of a composite material or any other suitable material. The inserts 38, 40 may be manufactured using known processes, including but not limited to thermoforming, blow molding or injection molding.

In other embodiments, the front graphical element 34 is applied directly on the inner surface 42 defining the front cavity 30. Similarly, the rear graphical element 36 is applied directly on the inner surface 44 of the rear portion 26 defining the rear cavity 32. In a specific embodiment, each one of the front and rear graphical elements 34, 36 is implemented as paint applied to the inner surfaces 42, 44. For instance, the paint can be applied using a paintbrush or can be spray-paint. In another embodiment, the front graphical element 34 is a sticker affixed to the inner surface 42 and, similarly, the rear graphical element 36 is a sticker affixed to the inner surface 44. The sticker affixed to each one of the inner surfaces 42, 44 can be any type of sticker, including an ink transfer sticker which is initially applied on a surface and subsequently removed in order to leave a design on the surface.

In other embodiments, the front and rear graphical elements 34, 36 may be colored foam injected in the respective front and rear cavities 30, 32. In fact, the front and rear graphical elements may be made of a material that can be catalyzed to a liquid foamed state and which will cure relatively rapididly. One such material is polyurethane.

Although the above description and FIGS. 2 to 8 illustrate specific embodiments of the front and rear graphical elements 34, 36, it is to be understood that various other embodiments of the front and rear graphical elements 34, 36 are possible without departing from the scope of the invention.

In view of the foregoing, it will be appreciated that the combination of the clear material and the front and rear graphical elements 34, 36 allows the blade holder 12 to be imparted with various colors and/or other visual characteristics. Furthermore, the front and rear graphical elements 34, 36 are protected from abrasion and deterioration due to impacts since they are respectively located inside the front and rear cavities 30, 32.

Each one of the front and rear graphical elements 34 and 36 permits a customization of the appearance of the blade holder 12. A hockey store can therefore provide to a customer a blade holder body being at least partly made of a clear material and comprising a front pedestal with a front inner surface, a rear pedestal with a rear inner surface and a bridge portion interconnecting said front and rear pedestals, the front and rear inner surfaces defining respective front and rear cavities. The hockey store can also provide to the customer a plurality of graphical elements to be provided into the front and rear cavities. The store can receive from the customer an indication of the graphical element that is desired to be present in the blade holder. Two different or identical graphical elements can be provided in the front and rear cavities of the respective front and rear pedestals. For example, the graphical elements that are desired to be present in the blade holder can include the main color(s) associated with the hockey team, the logo of the hockey team, and the number of the player on the hockey team. For example, the store can provide the front and rear graphical elements such that the front graphical element includes a colored area containing the main color(s) associated with the hockey team as well as the logo of the hockey team, and the rear graphical element includes a colored area containing the main color(s) associated with the hockey team as well as the number of the hockey player. The graphical element may be mounted in the cavity of the pedestal, affixed to the inner surface of the cavity or be painted on this inner surface.

Although various embodiments have been illustrated, this was for the purpose of describing, but not limiting, the invention. Various modifications will become apparent to those skilled in the art and are within the scope of the present invention, which is defined more particularly by the attached claims.

The invention claimed is:

1. A method of customizing a blade holder for an ice skate, comprising:

(a) providing to a customer a blade holder body being at least partly made of a clear material and comprising a front pedestal with a front inner surface, a rear pedestal with a rear inner surface and a bridge portion interconnecting said front and rear pedestals, the front and rear inner surfaces defining respective front and rear cavities;

(b) providing to the customer a plurality of graphical elements;

(c) receiving from the customer an indication of a certain graphical element selected from the plurality of graphical elements; and (d) applying the selected graphical element to one of the front and rear inner surfaces such that the selected graphical element is visible through the clear material.

2. A method of customizing a blade holder as defined in claim 1, wherein the step of applying the selected graphical element comprises affixing the selected graphical element on one of the front and rear inner surfaces.

3. A method of customizing a blade holder as defined in claim 1, wherein the step of applying the selected graphical element comprises painting the selected graphical element on one of the front and rear inner surfaces.

4. A method of customizing a blade holder as defined in claim 2, further comprising affixing a second selected graphical element on the other of the front and rear inner surfaces.

5. A method of customizing a blade holder as defined in claim 3, further comprising painting a second selected graphical element on the other of the front and rear inner surfaces.

* * * * *